US005640710A

United States Patent [19]

Kobayashi et al.

[11] Patent Number: 5,640,710

[45] Date of Patent: Jun. 17, 1997

[54] METHOD FOR MELT-DECONTAMINATING METAL CONTAMINATED WITH RADIOACTIVE SUBSTANCE

[75] Inventors: Hiroaki Kobayashi; Hiroshi Igarashi, both of Hitachinaka; Michiru Fujita, Ichihara, all of Japan

[73] Assignee: Doryokuro Kakunenryo Kaihatsu Jigyodan, Tokyo-to, Japan

[21] Appl. No.: 561,863

[22] Filed: Nov. 22, 1995

[30] Foreign Application Priority Data

Nov. 25, 1994 [JP] Japan ..... 6-290785

[51] Int. Cl.[6] ..... A62D 3/00

[52] U.S. Cl. ..... 588/201; 75/10.47; 976/DIG. 376

[58] Field of Search ..... 75/393, 396, 10.46, 75/10.47; 423/3–5; 588/1, 201; 976/DIG. 376

[56] References Cited

U.S. PATENT DOCUMENTS 3,102,849 9/1963 Vander et al. .
5,348,567 9/1994 Chappell ..... 75/10.66
5,461,185 10/1995 Forsberg et al. ..... 588/11

FOREIGN PATENT DOCUMENTS 61-26898 2/1986 Japan .
6-96852 4/1994 Japan .

OTHER PUBLICATIONS

Kagaku Binran (2nd edition) edited by The Chemical Society of Japan, p. 667 (1958) "Rare Metal Dictionary" edited by Japan Technology Transfer Association, p. 209, published by Japan Techno System Co., Ltd.

*Primary Examiner*—Ngoclan Mai
*Attorney, Agent, or Firm*—Wenderoth, Lind & Ponack

[57] ABSTRACT

A flux for effectively melt-decontaminating a zircaloy contaminated with a radioactive contaminant $Pu_2O_3$ is provided. The flux comprises a mixture of a metal flux of a metal (e.g. Ca or Mg) having a higher chemical activity than plutonium at a temperature above the melting point of the zircaloy with a halide flux of metallic compound (e.g. $SnF_2$, $PbF_2$, $CoF_2$, $CsF_2$) of a halogen element having a higher atomic number than fluorine and has a smaller absolute value of the standard free energy of formation than a fluorination product of plutonium (i.e. PuOF). The addition of the flux to a molten zircaloy causes plutonium contained in the melt to be converted, through a two-step reaction, to PuOF which can be then separated as slag.

6 Claims, No Drawings

METHOD FOR MELT-DECONTAMINATING METAL CONTAMINATED WITH RADIOACTIVE SUBSTANCE

BACKGROUND OF THE INVENTION

The present invention relates to a method for melt-decontaminating a metal contaminated with a radioactive. substance, by adherence of a very small amount of the radioactive substance on the metal in nuclear facilities, which comprises melting the contaminated metal, adding a flux to the molten metal to combine the flux with the radioactive substance and separating the combined radioactive substance from the metal. In particular, it relates to a flux composition suitable for removing a radioactive substance as a contaminant from a zircaloy used as a cladding tube for a nuclear fuel rod.

A zircaloy is an alloy comprising zirconium (Zr) and tin (Sn) and other metals added thereto. By virtue of the minimum neutron capture cross section, zirconium in the form of an alloy with, as described above, a very small amount of another metal incorporated into zirconium in order to improve properties, such as mechanical strength, is used as a cladding tube for a nuclear fuel rod. A spent fuel rod is separated into a fuel portion and a cladding tube which are then processed respectively. In this case, a transuranium substance, such as plutonium (Pu), is adhered onto the cladding tube although the amount of the adhered transuranium substance is very small. That is, the cladding tube is in the state of being contaminated with a radioactive substance. Decontamination by removing the radioactive substance from the zircaloy enables the zircaloy to be reusable and, in addition, can offer various advantages in storage of the zircaloy.

One known method for decontaminating a metal contaminated with a radioactive substance comprises melting a contaminated metal, adding a flux or a slagging agent to the melt to combine the additive with the radioactive substance, and separating the radioactive substance from the contaminated metal (see, for example, Japanese Patent Laid-Open No. 61-26898/1986).

In the conventional melt decontamination, iron (Fe),for example, is decontaminated, and an Inorganic oxide, such as silicic acid ($SiO_2$) or calcia (CaO), is generally used as the flux in this case.

Since zircaloy has a melting point as high as 1850° C., difficulties are experienced in melting the zircaloy in a conventional melting furnace. In this case, the use of a floating-type melting apparatus, wherein a molten metal is floated so as not to be brought into direct contact with a crucible (see, for example, Japanese Patent Laid-Open No. 6-96852/1994), enables the decontamination to be carried out in the same manner as described above even in the case of a zircaloy having a high melting point.

Since, however, the melting point of the above-described flux is so low that the flux is evaporated at the melting point of the zircaloy, the flux cannot be chemically reacted with the radioactive substance efficiently. Further, since the zircaloy has a high chemical activity, even though the flux could be chemically reacted, it is unfavorably reacted with zirconium in the zircaloy, which inhibits the reaction of the flux with the radioactive substance, making it impossible to attain a contemplated decontamination effect.

SUMMARY OF THE INVENTION

An object of the present invention is to solve the above-described problems and to provide a method for melt-decontaminating a metal contaminated with a radioactive substance, wherein a flux is used having the effect of highly removing a radioactive oxidized substance even when a contaminated metal is a zircaloy having a high melting point and a high chemical activity.

In order to solve the above-described problems, the present invention provides a method for melt-decontaminating a metal contaminated with a radioactive substance, comprising the steps of: melting a metal contaminated with a radioactive substance; adding a flux to the molten contaminated metal to combine the flux with the radioactive substance to form slag; and separating the slag from the contaminated metal, characterized in that the contaminated metal is a zircaloy and the flux is a mixture of a metallic flux with a halide flux, the chemical activity of the metallic flux is higher than that of the radioactive substance at a temperature above the melting point of the zircaloy, and the halide flux is a metallic compound of a halogen element having a higher atomic number than fluorine and has a smaller absolute value of the standard free energy of formation than a fluorination product of the radioactive substance at the melting point of the zircaloy and, at the same time, has a boiling point above the melting point of the zircaloy.

The metal flux is preferably calcium (Ca) or magnesium (Mg). The metallic element of the halide flux is preferably tin (Sn), lead (Pb), cobalt (Co) or cesium (Cs). The halogen element is preferably fluorine (F).

In the present invention, when the contaminated metal is a zircaloy, a mixture of a metallic flux with a halide flux is used as a flux, as described above. Since the metallic flux has a higher activity than a radioactive oxide, the addition of this flux to the molten zircaloy causes the flux to capture oxygen in the radioactive oxide, whereby the flux is brought to an oxide with the radioactive substance reduced to the metal being combined with a halogen in the halide flux resulting in the formation of a fluorocompound. The fluorocompound is separated as slag from the molten metal and floats on the surface of the melt. Since the halogen in the halide flux has a higher atomic number than fluorine, the boiling point of the metallic compound thereof is above the temperature of the molten zircaloy, enabling the metallic compound to effectively take part in the chemical reaction. Further, since the absolute value of the standard free energy of formation of the halide flux is smaller than that of a fluorocompound as a fluorination product of the radioactive substance, the fluorocompound of the radioactive substance is effectively produced.

Calcium (Ca) or magnesium (Mg) as the metallic flux, tin (Sn), lead (Pb), cobalt (Co) or cesium (Cs) as the metallic element in the halide flux, and fluorine as the halogen element are easily commercially available and easy to handle and, at the same time, can effectively act as the flux.

PREFERRED EMBODIMENTS OF THE INVENTION

The present invention will now be described with reference to the following example wherein plutonium is exemplified as a radioactive substance. Calcium (Ca) is used as a metallic flux, and tin fluoride ($SnF_2$) is used as a halide flux. The addition of the above-described flux to a zircaloy in a molten state in the above-described floating-type melting apparatus gives rise to the following chemical reaction. Since the zircaloy, which has been used as a cladding tube of a fuel rod, is contaminated with a very small amount of plutonium oxide ($Pu_2O_3$), the molten zircaloy metal also contains a very small amount of plutonium oxide ($Pu_2O_3$).

The flux is chemically reacted with the molten metal as follows. The chemical reaction is based on a numerical experiment. As is well known, since it is difficult to obtain plutonium oxide ($Pu_2O_3$), a numerical experiment is substituted for the chemical reaction of plutonium oxide. In the numerical experiment, a chemical equilibrium calculation program "gem" (trade name) included in a thermodynamic data base "MALT 2" (trade name) manufactured by K. K. Kagaku Gijutsusha is used as a calculation program. The chemical reaction between a mixture of the metallic flux with the halide flux and the molten metal proceeds through the following two steps.

[First reaction] (1)

$$\underset{0.17}{Pu_2O_3} + \underset{12.4}{Ca} + \underset{96.3}{Zr} + \underset{1.1}{Sn} \longrightarrow \underset{0.32}{Pu} + \underset{0.17}{CaZrO_3} + \underset{1.10}{Ca_2Sn} + \underset{96.14}{Zr} + (\uparrow \underset{10.02}{Ca})$$

Specifically, plutonium oxide ($Pu_2O_3$) having a high activity is reduced by calcium (Ca) having a higher activity to give metallic plutonium (Pu). Besides calcium (Ca), magnesium (Mg) is also suitable for this purpose. Although sodium (Na) and potassium (K) are also usable, they are not easy to handle and, hence, in some cases, not suitable for practical use. In the reaction formula, tin (Sn) is contained in the zircaloy. Further, numerical values provided below respective chemical formulae are relative amounts in mole of molecules represented by the respective chemical formulae. The sum of the relative amounts in the chemical formulae constituting the left side is approximately 100, and the sum of the relative amounts in the chemical formulae constituting the right side is approximately 100. The symbol within the parentheses in the last of the right side represents that calcium (Ca) is gasified and evaporated. This representation is similar in the following reaction formula.

[Second reaction] (2)

$$\underset{0.32}{Pu} + \underset{2.04}{SnF_2} + \underset{0.17}{CaZrO_3} + \underset{1.10}{Ca_2Sn} + \underset{96.1}{Zr} \longrightarrow \underset{0.32}{PuOF} + \underset{0.06}{CaZrO_3} + \underset{0.33}{CaF_2} + \underset{1.10}{Ca_2Sn} + \underset{96.24}{Zr} + \underset{2.04}{Sn} + (\uparrow \underset{7.29}{Ca}, \underset{1.94}{CaF})$$

Specifically, metallic plutonium (Pu) captures fluorine (F) in tin fluoride ($SnF_2$) to give plutonium oxyfluoride (PuOF). This compound (PuOF) is separated as slag from the molten zircaloy. Since the slag has a smaller specific gravity than the molten zircaloy, it floats on the surface of the melt, thus enabling the separation of the slag. When cooling is carried out in this state, slag is collected on the surface of the metal.

Tin fluoride ($SnF_2$) is one of compounds selected as satisfying two requirements, i.e., a requirement that no gasification occurs at the molten zircaloy temperature and a requirement that the absolute value of the standard free energy of formation is as small as possible when compared with that of a fluorination product of plutonium (Pu). The standard free energy of formation is referred to simply as standard free energy or more simply as free energy (see Kagaku Binran (2nd ed.), edited by The Chemical Society of Japan, P. 667). That a compound has a small absolute value of the standard free energy of formation means that this compound is more unstable than a compound having a larger absolute value of the standard free energy of formation. Therefore, upon addition to the molten zircaloy, tin fluoride ($SnF_2$) is easily decomposed to give fluorine (F) to plutonium (Pu). The absolute value of the fluoride of zirconium (Zr) is larger than that of tin fluoride ($SnF_2$). Since, however, the absolute value of the free energy of plutonium oxyfluoride (PuOF) is larger than that of the fluoride of zirconium (Zr) although this is not described in the document cited below, fluorine dissociated from tin fluoride ($SnF_2$) is combined with plutonium (Pu) to give plutonium oxyfluoride (PuOF), and there is no possibility that zirconium (Zr) captures fluorine (F) to inhibit the formation of plutonium oxyfluoride (PuOF).

Fluorides having small free energy values include, besides tin fluoride ($SnF_2$), lead fluoride ($PbF_2$), cobalt fluoride ($CoF_2$), and cesium fluoride ($CsF_2$) (see "Rare Metal Dictionary" edited by Japan Technology Transfer Association, p. 209, published by Fuji Techno System Co., Ltd.). Since the boiling point of these fluorides is above the melting point of the zircaloy, there is no possibility that the fluoride is evaporated resulting in a lowered efficiency in the formation of slag by combining the fluoride with plutonium. In addition to the above fluorides, zinc fluoride ($ZnF_2$), nickel fluoride ($NiF_2$) and the like also have a smaller absolute value of the free energy. Since, however, these fluorides have a low boiling point, which is close to or below the melting point of the zircaloy, they are unsuitable as a flux for decontamination of the zircaloy.

Giving attention to plutonium (Pu), a combination of the first reaction with the second reaction provides the following chemical formula (expressed in terms of number of molecules):

$$6Pu_2O_3 + 12Ca + 9SnF_2 + 2Zr + 2Sn \longrightarrow 12PuOF + 2CaZrO_3 + 2CaF_2 + 2Ca_2Sn + 9Sn + 2Ca + 2CaF \quad (3)$$

Specifically, plutonium oxide ($Pu_2O_3$) as a radioactive substance to be removed is converted to plutonium oxyfluoride (PuOF) by a two-step reaction. Zirconium (Zr) is also converted in an amount of one-twelfth (in terms of atomic ratio) of plutonium (Pu) to a compound ($CaZrO_3$). However, as is apparent from the reaction formulae (1) and (2), the amount of the converted zirconium is very small based on the total amount of zirconium (Zr).

Since plutonium oxyfluoride (PuOF) has a smaller specific gravity, it floats as slag on the surface of the molten metal. Upon cooling after the completion of melting of the metal, slag is collected on the surface of the solidified substance. The removal of this slag by machining or the like provides a zircaloy free from plutonium oxide ($Pu_2O_3$).

As described above, according to the present invention, a flux comprising a mixture of a metallic flux having a high melting point and a high chemical activity with a halide flux in the form of a metallic compound of a halogen element having a higher atomic number than fluorine is prepared and added to a molten zircaloy In a melting furnace. This causes a radioactive substance as a contaminant, which is present in a molten state together with the zircaloy, to be converted, through a two-step reaction, to a fluorocompound which is then separated as slag from the zircaloy and floats on the surface of the molten metal. The melt is then cooled, and the surface of the solidified substance is scraped or cut off to remove the slag, thereby providing a zircaloy with the contaminant removed therefrom. As a result, the processed zircaloy can be reused as a cladding tube. Further, the decontaminated zircaloy is easy to handle and to store in various respects.

Further, the use of a flux comprising a combination of calcium (Ca) or magnesium (Mg) as a metallic flux, tin (Sn), lead (Pb), cobalt (Co) or cesium (Cs) as a metallic element in a halide flux, and fluorine as the halogen element can ensure the decontamination and, at the same time, has an advantage that the materials used are easily available.

What is claimed is:

1. A method for melt-decontaminating a metal contaminated with a radioactive substance, comprising the steps of: melting a metal contaminated with a radioactive substance; adding a flux to the molten contaminated metal to combine the flux with the radioactive substance to form slag; and separating the slag from the contaminated metal, characterized in that the contaminated metal is a zircaloy and the flux is a mixture of a metallic flux with a halide flux, the chemical activity of the metallic flux is higher than that of the radioactive substance at a temperature above the melting point of the zircaloy, and the halide flux is a metallic compound of a halogen element having a higher atomic number than fluorine and has a smaller absolute value of the standard free energy of formation than a fluorination product of the radioactive substance at the melting point of the zircaloy and, at the same time, has a boiling point above the melting point of the zircaloy.

2. The method for melt-decontaminating a metal contaminated with a radioactive substance according to claim 1, characterized in that the radioactive substance is plutonium.

3. The method for melt-decontaminating a metal contaminated with a radioactive substance according to claim 2, characterized in that the metallic flux is calcium (Ca) or magnesium (Mg).

4. The method for melt-decontaminating a metal contaminated with a radioactive substance according to claim 2 or 3, characterized in that the metallic element in the halide flux is tin (Sn), lead (Pb), cobalt (Co) or cesium (cs).

5. The method for melt-decontaminating a metal contaminated with a radioactive substance according to claim 2 or 3, characterized in that the halogen element is fluorine (F).

6. The method for melt-decontaminating a metal contaminated with a radioactive substance according to claim 4, characterized in that the halogen element is fluorine (F).

* * * * *